US005743420A

United States Patent [19]

Löffler et al.

[11] Patent Number: 5,743,420

[45] Date of Patent: Apr. 28, 1998

[54] PLASTIC CLOSURE

[75] Inventors: Manfred Löffler, Tellig; Hans-Joachim Preuss, Monsheim, both of Germany

[73] Assignee: Alcoa Deutschland GmbH, Worms/Ehein, Germany

[21] Appl. No.: 495,446

[22] PCT Filed: Dec. 1, 1993

[86] PCT No.: PCT/EP93/03360

§ 371 Date: Oct. 30, 1995

§ 102(e) Date: Oct. 30, 1995

[87] PCT Pub. No.: WO94/16962

PCT Pub. Date: Aug. 4, 1994

[30] Foreign Application Priority Data

Jan. 20, 1993 [DE] Germany ..... 43 01 306.6

[51] Int. Cl.[6] ..... B65D 53/00

[52] U.S. Cl. ..... 215/270; 215/344; 215/350

[58] Field of Search ..... 215/341, 343, 215/342, 344, 346, 352, 307, 349, 350, 270

[56] References Cited

U.S. PATENT DOCUMENTS

| | | | |
|---|---|---|---|
| 3,784,041 | 1/1974 | Birch | 215/344 X |
| 4,090,631 | 5/1978 | Grussen | 215/329 |
| 4,125,201 | 11/1978 | Birch | 215/330 |
| 4,276,989 | 7/1981 | Hicks | 215/270 |
| 4,462,502 | 7/1984 | Luenser et al. | 215/329 |
| 4,629,083 | 12/1986 | Druitt | 215/329 |
| 5,285,913 | 2/1994 | Morton | 215/349 |
| 5,423,444 | 6/1995 | Druitt | 215/344 |

*Primary Examiner*—Stephen Cronin

*Attorney, Agent, or Firm*—Dressler, Rockey, Milnamow & Katz, Ltd.

[57] ABSTRACT

There is proposed a plastic closure which serves to close a container (3) with a mouth region (5). The closure (1) has a lid (7) allocated to the container mouth (5) and an annular side wall (9) connected with this. On the inner surface (15) of the side wall (9) there are provided fastening means (16) which coact with corresponding fastening means (14) on the outer surface (11) of the container (3) and are constructed, for example, as screw threads. The closure has, finally, also a sealing means. It is distinguished in that the sealing means (11) has a circumferential pivotable sealing lip (9) projecting from a support (15), which lip coacts with a side wall (25) surrounding the container mouth (21) of the container (19), which in the closing of the container is swung out of a rest position into a sealing position and which in its sealing position is clamped between support and side wall of the container so that it is subjected to a compression.

2 Claims, 8 Drawing Sheets

PLASTIC CLOSURE

TECHNICAL FIELD

The invention relates to a plastic closure for closing a mouth region of a container, with a cover allocated to the container mouth, an annular side wall proceeding from the cover and connected thereto, as well as a sealing arrangement closing the container.

BACKGROUND

Plastic closures of the type here addressed, in particular for the closing of bottles, are known. They have the disadvantage that they cannot always ensure the secure closing of a container.

It is an object of the invention, therefore, to provide a plastic closure that ensures a secured closing of a container.

SUMMARY OF THE INVENTION

This problem is solved in the case of a plastic closure of the type mentioned at the outset with the aid of the features listed in claim 1. The closure is distinguished, accordingly, in that the sealing arrangement has a pivotable sealing lip which projects from a support. In the closing of the container the sealing lip is swung out of a rest position into a sealing position, in which it is clamped between the support and the side wall of the container so that it is subjected to a compression. By the compressive forces arising there the sealing lip is pressed firmly against a side wall of the container, so that there is ensured a tight closure even with an excess pressure in the container. By reason of the pivotability of the sealing lip, the latter, however, can execute a yielding movement: With an especially high excess pressure in the interior of the container the sealing lip is swung back in the direction of its rest position, in which the container is no longer closed, so that the excess pressure can be dissipated.

In a preferred example of execution, the sealing lip springs over a distance to the cover from the inner surface of the side wall, which then, as it were, forms the support of the sealing lip. Such a closure can be produced especially simply and economically, because the formation of a separate support can be omitted.

In a further preferred embodiment of the plastic closure the sealing lip is provided with an operating arrangement which arises at the end of the sealing lip which lies opposite the support. The pivotal movement of the sealing lip is supported by the operating arrangement in the closing of the container. By such a construction dimensional tolerances between closure and container can be compensated for especially well. If, therefore, a closure with especially great inside diameter is emplaced on a container with especially small outside diameter, at least the operating arrangement still enters into engagement with the mouth region, respectively the side wall of the container, so that the sealing lip is swung in the closing of the container and brought into its sealing position. In the equipping of the sealing lip with an operating arrangement the sealing lip can be clamped and compressed between its support and the operating arrangement, so that the sealing effect is therewith achieved.

There is preferred an embodiment of the closure as a surrounding flange in which the operating arrangement formed of the sealing lip, after the emplacement of the closure, is bent over regionally on the container and lies flush against the side wall of the container. In this manner the sealing effect of the sealing arrangement is increased with rising internal pressure of the container. If the internal pressure of the container exceeds a certain measure, then the sealing lip with the flange can yield following the pressure, possibly even flip over. At any rate the interior of the container is freed and a venting is brought about so that a bursting of the container can be excluded with certainty. The venting pressure of the closure can be varied by the length of the sealing lip, respectively of the bent-over region of the flange.

A further embodiment of the closure is preferred for the reason that its sealing arrangement has at least one press-on web which presses the flange of the sealing lip in the closed state of the container against its side wall. In this manner there is ensured a higher sealing effect of the sealing arrangement, i.e., the flipping-over of the sealing lip in this embodiment takes place at a higher internal pressure of the container.

Further preferred is an embodiment of the closure in which the press-on web is constructed as a surrounding annular web, in which in the contact region between annular web and sealing lip there is provided at least one gas passage which allows the internal pressure in the interior of the container to pass to the rear of the bent-over region of the sealing lip, so that this latter is pressed against the side wall of the container. In this manner the excess pressure of the container maintained by the closure can be increased.

Further, an embodiment of the closure is preferred in which, proceeding from its cover, a stop is provided which in the emplacing of the closure coacts with the surface surrounding the mouth of the container, so that a defined closure torque can be set. The stop has, in turn, at least one gas passage, so that the pressure acting in the interior of the container can pass through the stop and reach the flange of the sealing lip, so that this, as mentioned above, is pressed by the internal pressure in the container against its side wall.

In a further preferred example of execution of the plastic closure the sealing arrangement has a sealing disk which stretches over the mouth region of the container. The outside diameter of the sealing disk is chosen so that its outer border zone coacts with the sealing lip. There the border zone of the sealing disk in the closed state of the container is clamped between sealing lip and side wall of the container, in which state, on the one hand, the sealing lip is compressed and, on the other hand, a tight closure is achieved between side wall of the container and sealing disk, in that the sealing disk is pressed against the container by the sealing lip.

Finally there is preferred a form of execution of the plastic closure in which the sealing disk is provided with an interlocking means that is formed preferably by a bent-over border section of the disk. With a corresponding dimensioning of the disk, in the closing of the container the sealing lip is swung by the bent-over border section into its sealing position. The sealing lip is therewith clamped between its support and the side wall of the container, the sealing disk being clamped here between the end of the sealing lip which is remote from the supporting region and the side wall of the container.

Further embodiments of the closure are yielded from the remaining subsidiary claims.

BRIEF DESCRIPTION OF THE DRAWINGS

The invention is explained in detail in the following with the aid of the drawing, in which.

DETAILED DESCRIPTION

Figure 1:
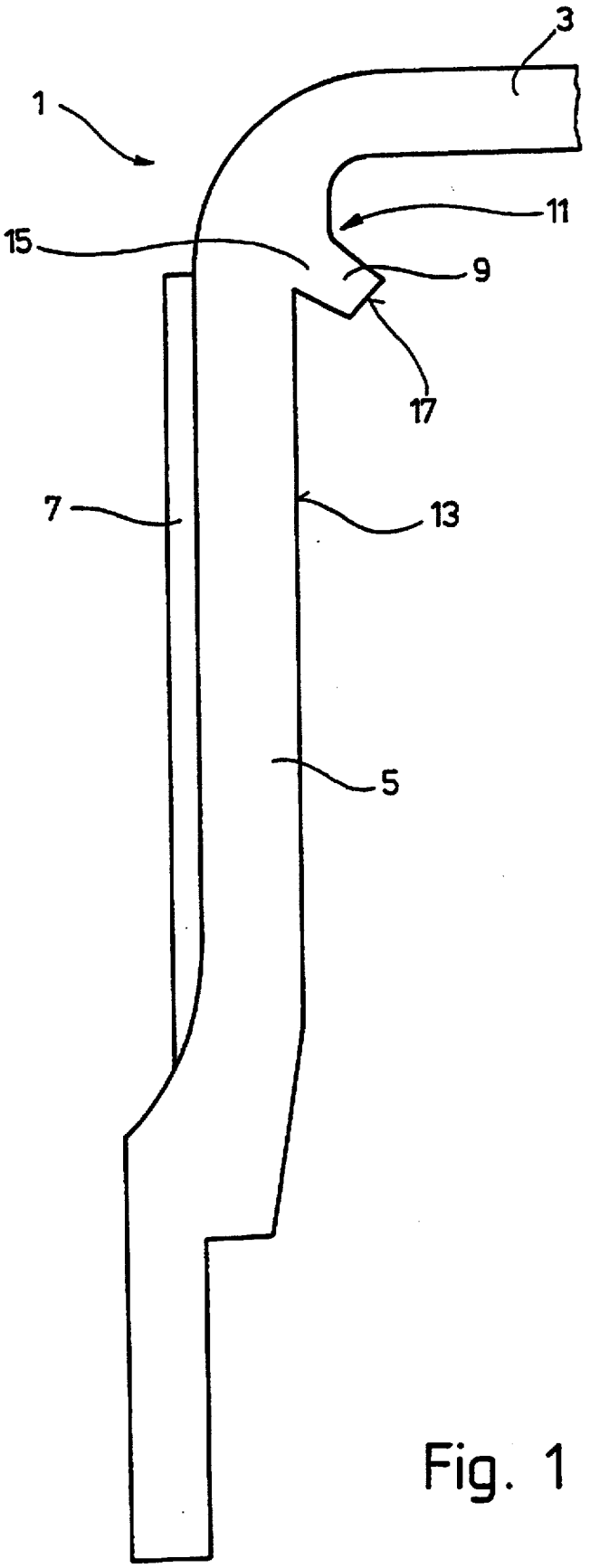
FIG. 1 shows a highly schematic partial section through a first embodiment of a plastic closure.

From the representation according to FIG. 1 it is evident that the plastic closure 1 has a lid 3 which forms, as it were, the bottom of the cap-shaped closure. It serves to close the mouth region of the container to be closed.

From the lid 3 there proceeds a surrounding annular side wall, which may be provided on its inside with a locking means (not represented here). The locking means can be so designed that the plastic closure is constructed as a screw closure or as a bayonet closure or even as a so-called wide-neck closure. On the outside of the side wall ribs 7 may be provided to improve the gripping characteristics of the plastic closure 1.

From the side wall 5 at a distance from the lid 3 there projects a sealing lip 9, which is part of a sealing means 11. The sealing lip 9 is formed in one piece with the plastic closure 1 and arises at a distance to the lid 3 from the inner surface 13 of side wall 5, which here serves as a support region 15 of the sealing lip 9. The radially innermost edge of the sealing lip 9, i.e. the end 17 of the sealing lip lying opposite the support region 15 includes an inner radius which is adapted to the outer diameter of the container to be closed.

In the rest position represented in FIG. 1 the sealing lip 9 proceeds at an angle sloping slightly from above downward into the interior of the plastic closure 1.

The sealing lip 9 of the sealing means 11 is constructed in rotary form, i.e. it forms a ring revolving on the inside of the plastic closure 1, which ring bears on the outer side wall of the container to be closed.

Figure 2:
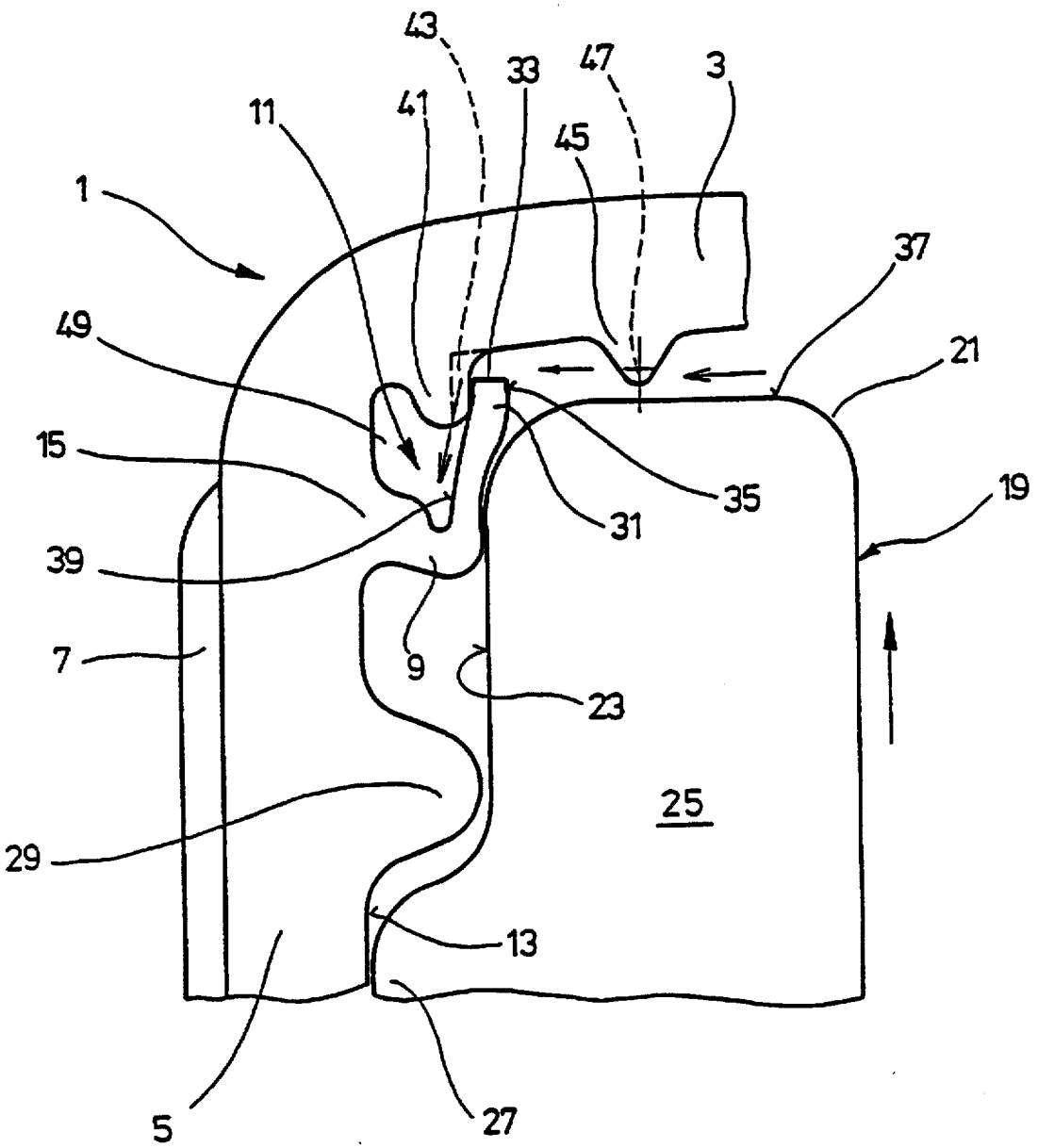
FIG. 2 a highly schematic partial section through a further embodiment of a plastic closure emplaced on a container.

From the partial elevation in FIG. 2 there is to be seen a second embodiment of a plastic closure 1, which is placed on a container 19. Parts which correspond with those in FIG. 1 are provided with the same reference numbers, so that in such respect reference is made to the preceding description. The partial section according to FIG. 2 shows the marginal region of the container mouth 21 to be closed. The lid 3 of the plastic closure is to span completely the container mouth 21. Proceeding from the rim of the lid 3 there extends the annular side wall 5 which passes around the outer surface 23 surrounding the container mouth 21 of the side wall 25 of the container 19. On this there is provided as locking means, respectively as fastening means, an outside thread 27, which coacts with corresponding fastening means of the plastic closure, here with an inside thread 29. On the outside of the side wall 5 ribs, running parallel to the axis of rotation of the plastic closure, for example, are provided to improve gripping characteristics of the closure 1.

From the inner surface 13 of the side wall 5, at a distance below the underside of the lid 3, there arises the circumferential sealing lip 9. It is mounted on the inner surface of the closure, for example molded on, and constructed preferably in one piece with the plastic closure 1.

In the embodiment represented here of the plastic closure 1 the sealing means 11 is characterized in that from the end 17 of the sealing lip 9, lying opposite to the supporting region 15, there arises a flange 31 serving as an operating means, which is here constructed circularly and presents, as it were, an extension of the sealing lip 9.

The length of the sealing lip 9 provided with the flange 31 is chosen in such manner that it extends so far into the interior of the plastic closure 1 that the diameter of a circle circumscribed by the inner edge 33 of the flange 31 is smaller than the outside diameter of the container 3. If, therefore, the plastic closure 1 is emplaced on the container 19, the region of the flange 31 adjoining the inner edge 33 is bent upward, so that it bears with its inside 35, now lying in the direction toward the axis of rotation (not represented here) of the plastic closure against the outer surface 25 of the container 19. The length of the sealing lip 9 with the flange 31 is so selected that even with firmly emplaced plastic closure 1, it does not contact the face surface 37 of the container which surrounds the mouth 21.

It is evident that the flange 31 is pressed solely by reason of its spring action against the side wall 25 of the container 19. The sealing lip 9 is clamped here between inner surface 13 of the side wall 5 and outer surface 23 of the container 19 so that it is compressed. In order to avoid ripping of the sealing lip or of the flange, both, preferably the entire closure, are made of a sufficiently yielding plastic material.

Because the flange 31 is bent upward in its region adjoining the inner edge 33 and therefore runs at least in part essentially parallel to the outer surface 23 of the container 19, it is pressed against the outer surface of the container if a pressure acting in the interior of the container can pass to the outside 39 of the flange 31 and press the latter against the outer surface 23 of the container 19.

A gas communication between the interior of the container 19 and the outer side 39 of the flange 31 is indicated by arrows in FIG. 2.

The length of the flange 31 is chosen in such a way that it does not strike with its inner edge 33 against the underside of the lid 3 when it is bent over by a container 19 into the position represented according to FIG. 2. In the interest of safety, the inner edge 33 can be given a special configuration, for example a corrugation, in order to ensure a gas communication between the outer side 39 of the flange 31 and the interior of the container 19, even if by reason of unfavorable dimensional tolerances the flange 31 should be pressed with its inner edge 33 against the underside of the lid 3. In this manner it is ensured that the pressure prevailing in the interior of the container can pass to the outer side 39 of the flange 31 and press the latter against the outer surface of the container. In this manner there can be assured a very good sealing performance of the plastic closure.

If the internal pressure in the container 19 rises, then this acts not only on the outer side 39 of the flange 31 which runs parallel to the outer surface 23 of the container 19, but also on the sealing lip which in the sealing position shown in FIG. 2 runs more or less horizontally, i.e., parallel to the lid 3. In the event of a rise of the internal pressure the sealing lip is deflected downward, i.e., swung back in the direction of its rest position, so that possibly even the deflected region of the flange is totally flipped downward. In any case the interior of the container is freed and a venting is achieved. In this manner too high an internal pressure in the container 19 is avoided, so that the latter cannot burst.

The pressure at which the flange 31 with the sealing lip 9 yields or flips over depends on its length and thickness and, furthermore, it depends on the plastic material used in the manufacture. Here, the flange is constructed thinner than the sealing lip 9. Finally, a further factor is how far the inner surface 13 of the side wall 5 is spaced from the outer surface 23 of the container 19.

In the embodiment of the plastic closure 1 represented in FIG. 2 a press-on web 41 is provided, which is here formed as an annular beading projecting from the cover 3. It is also possible for the press-on web to be constructed as an annular beading running directly in the transition zone between lid 3 and side wall 5 which beading—otherwise than as represented in FIG. 2—does not protrude as if free-standing from the lid 3. The press-on web represented in FIG. 2, constructed as a free-standing annular beading can present projections distributed along an imaginary circular line or also be constructed as a continuous, annular projection. A very good sealing performance of the sealing arrangement 11 is ensured if even in the presence of a press-on web a gaseous communication is provided between the interior of the container 19 and the outer side 39 of the flange 31. This is certainly the case when the press-on web consists of individual projections distributed along a circular line. But even in the case of a continuous annular press-on web a gaseous communication can be ensured by the means that on the inside facing the imaginary central axis of the plastic closure 1 of the press-on web, recesses 43 are provided which are formed, for example, by groove-type depressions. For the production of a gas passage it is a matter of indifference whether such recesses are provided in the contact region between sealing lip and press-on web on the side of the press-on web 41 or on the side of the flange 31 facing the press-on web.

By such a press-on web the force is increased with which the flange, immediately after the emplacing of the plastic closure 1, is pressed against the outer surface 23 of the container 19. By the friction between press-on web and sealing lip the venting pressure is increased at which the flange is flipped over downwardly by the interior pressure in the container 19. The venting pressure can be varied, on the one hand, by the arrangement of the press-on web: If the inside diameter of the press-on web is reduced, the flange is pressed with a greater force against the outer surface of the container. With a larger inside diameter of the press-on web, correspondingly, the press-on force is decreased and the venting pressure reduced. On the other hand, the force with which the flange is pressed against the outer surface 23 of the container 19 can also be predetermined by the width and number of the recesses 43. In the case of very wide recesses relatively narrow webs remain with which the press-on web presses the flange against the outer surface 23 of the container 19. In this manner, therefore, a low venting pressure is set in.

The press-on forces with which on the one hand, the flange 31 presses against the outer surface 23 of the container 19 and, on the other hand, the press-on web 41 presses against the flange 31 is further influenced by the extent to which the plastic closure 1 is screwed more or less far onto the container 19. In the embodiment represented in FIG. 1, there arises within the press-on web 41 a stop 45 which in the screwing-down of the closure 1 impinges on the face surface 37 of the container 19 and prevents any further pressing of the lid 3 onto this face surface 37. By the height of the stop, therefore, the sealing performance of the closure can be adjusted.

The stop 45 can have several projections distributed along an imaginary circular line that runs preferably concentrically to the press-on web 41, or else a continuous annular rib the cross section of which according to FIG. 2 is made substantially triangular. By a broken line it is indicated in FIG. 2 that in the contact region between stop 45 and face surface 37 at least one gas passage 47 is provided, which is achieved, for example, by several grooves that are introduced into the contact surface of the stop 45. In this manner there is ensured an unhampered gas exchange with the interior of the container 19, so that an excess pressure can press the flange 31 against the outer surface 23 of the container 19.

Figure 3:
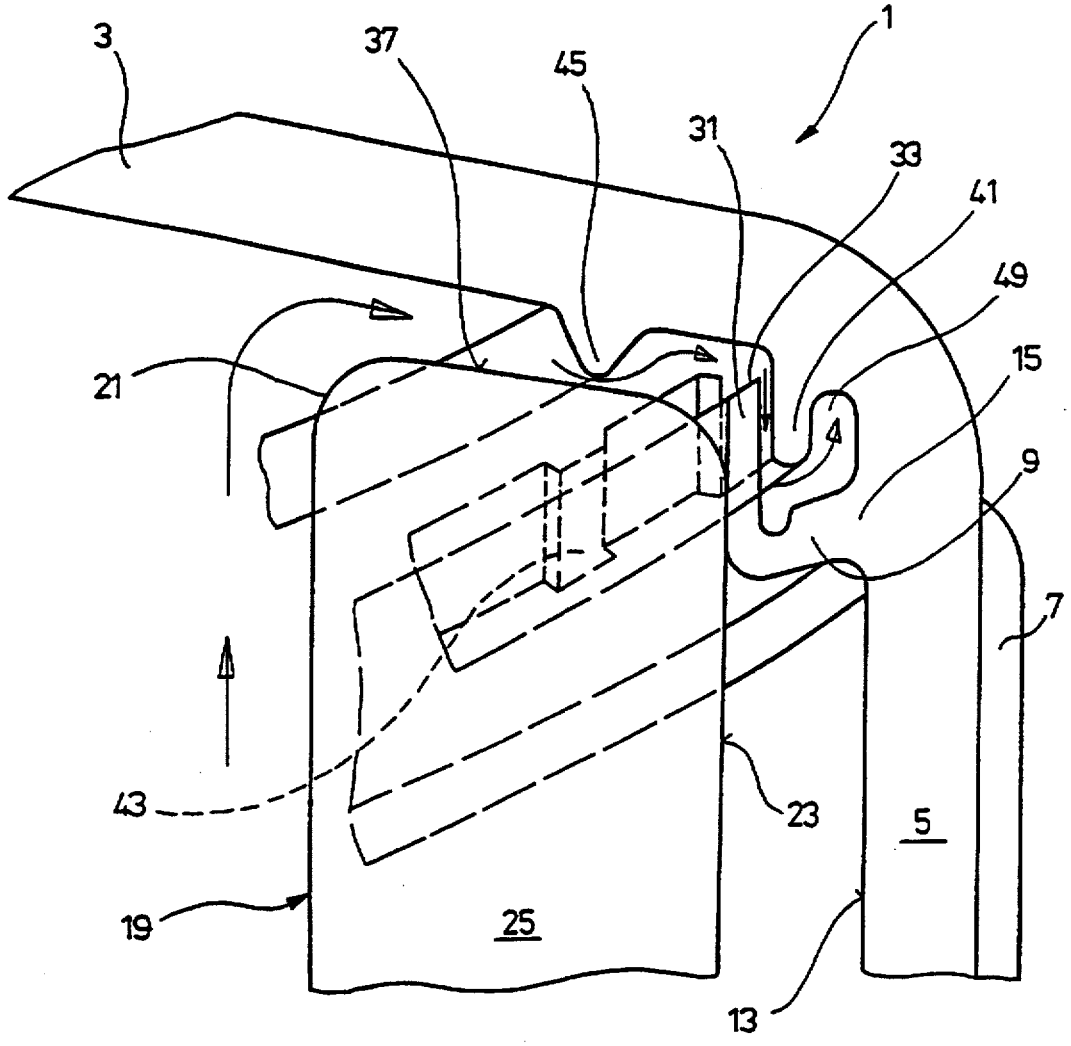
FIG. 3 a perspective theoretical sketch of the plastic closure according to FIG. 2 emplaced on a container.

The perspective representation given in FIG. 3 of a highly schematic partial section through a plastic closure 1, such as is represented in FIG. 2, once again makes clear its manner of functioning. Like parts are provided with the same reference numbers, so that reference can be made to the description for FIG. 2.

The plastic closure 1 is placed on container 19—indicated only by the contour line of its side wall—and closes this container pressure—tightly. It is held on the container by suitable fastening means, for example by a screw thread, but, for example, also by any arresting means yielding form closure. The sealing lip 9 arising at a distance from the lid 3 of the closure 1, from its side wall 5, is swung into its sealing position by the flange 21 and bent over with its section facing the inner edge 19, while the flange runs substantially parallel to the outer surface 23 of the container 19 lying there in sealing contact. The flange is pressed additionally by the press-on web 41 against the outer surface 23 of the container 19, in which process there is being established a gas communication between the interior of the container and a pressure chamber 49 bounded by the sealing lip 9. This is indicated by arrows in FIG. 3. By the excess pressure prevailing in the pressure chamber, as it is given in the interior of the container 19, the flange 31 is pressed against the outer surface 23 of the container 19, so that the sealing effect of the closure 1 is increased. Starting with a certain excess pressure, the sealing lip and the flange are flipped over downward, so that the sealing effect of the sealing arrangement 11 is suspended and a free access of the interior to the container to the environment is given.

Additionally, as explained with the aid of FIG. 2, from the underside of the lid 3 a stop 45 can project which has gas passages 47, through which an excess pressure prevailing in the interior of the container between the face surface 37 of the container and the stop 45 can pass and proceed through the recesses 43 in the press-on web 41 to the pressure chamber 49.

Figure 4:
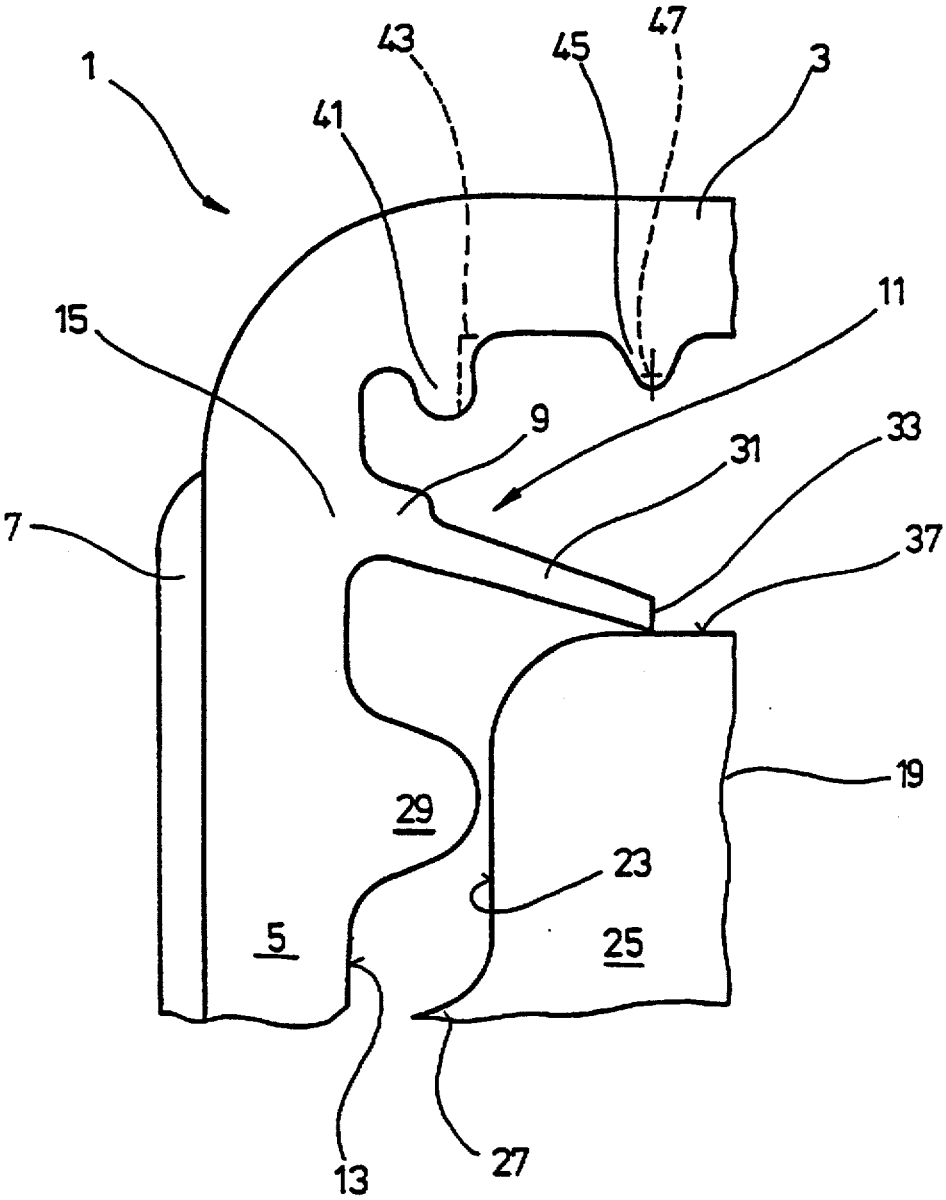
FIG. 4 a partial elevation of a closure that is emplaced loosely on a container.

From the theoretical sketch according to FIG. 4 it is evident that the sealing lip 9 and the flange before the screwing-down of the plastic closure 1 onto a container 19 extend rectilinearly proceeding from the side wall 5, i.e., without any deflection regions, into the interior of the closure 1, and project there at a distance from the lid 3 from the inner surface 13 of the side wall 5. The inner edge 33 of the flange runs along an imaginary circular line, the inside diameter of which is smaller than the outside diameter of the outer surface 23 of the container 19. Thereby the region of the flange 31 bounding on the inner edge 33 is bent upward in the emplacing on a container 19, as illustrated and explained with the aid of FIGS. 2 and 3.

From FIG. 4 it can be derived that the plastic closure 1 must be emplaced on the container 19 against the spring force of the flange 31, in which process then regions of the flange that bound its inner edge 33 are bent over upward in the direction toward the lid 3 and finally come into engagement with the press-on web 41 or enter into contact there.

Thereby, therefore, the flange is swung out of the range in which the stop 45 rests on the face surface 37 of the container, when the closure 1 has arrived in its closing position, as is evident from FIGS. 2 and 3. Simultaneously, by the bending-over of the flange 31 serving as operating arrangement the sealing lip 9 is swung out of its rest position into its sealing position and in the process clamped and compressed between side wall 5 of the closure and outer surface 23, of the container 19.

By the flipping upward of the flange and of the sealing lip there results the pressure chamber 49 explained with the aid of FIG. 3, which stands in pressure communication with the interior of the container 19 closed by the closure 1.

Figure 5:
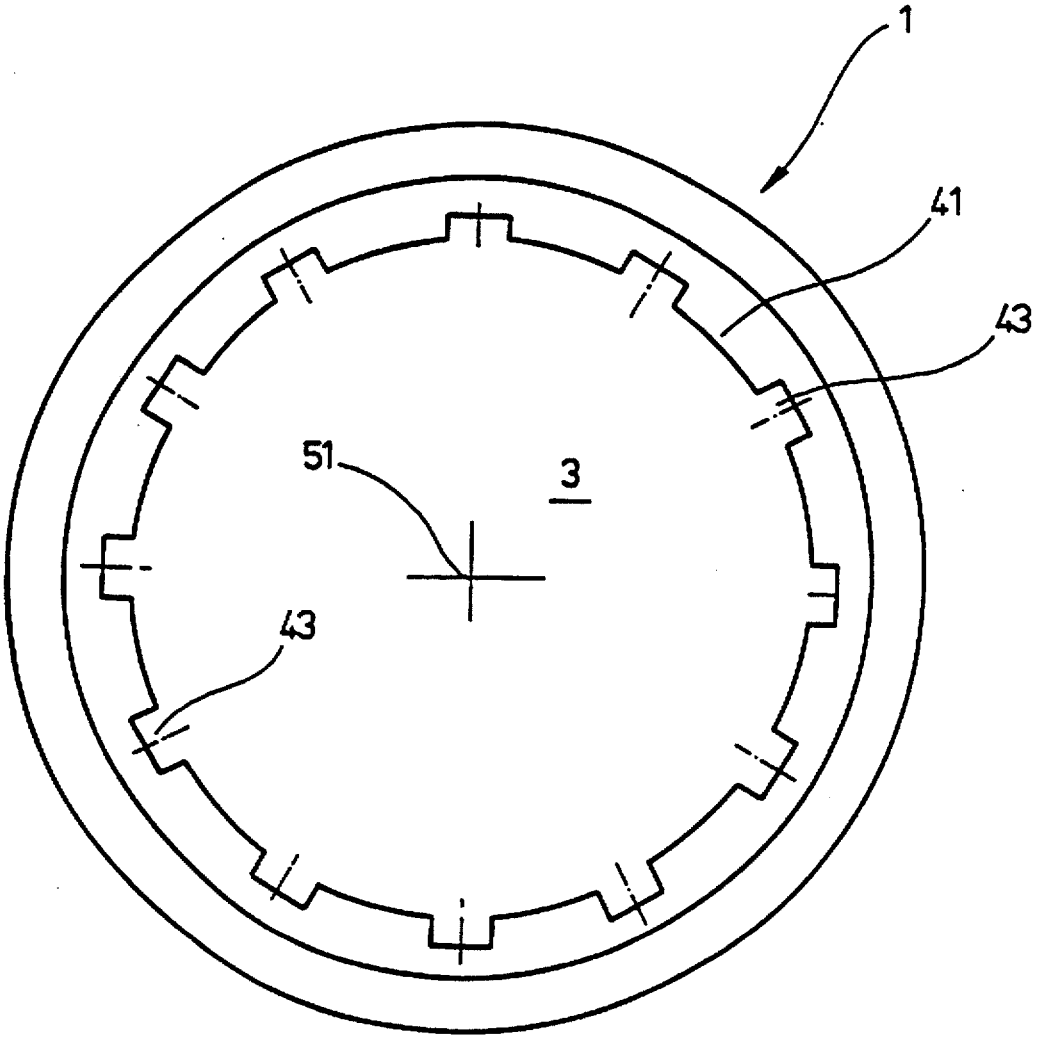
FIG. 5 a schematic inside view of the lid of a closure.

FIG. 5, finally, shows schematically an interior view of a lid 3 of a plastic closure 1. With this representation the design of the press-on web 41 is to be explained in detail. The stop 49 explained in the remaining figures is omitted here. It can, incidentally, be omitted in all cases in which a not especially precisely defined closing torque is to be ensured, by reason of which then also a certain opening torque is set in.

The press-on web 41 in the embodiment represented in FIG. 5 is designed as a continuous annular projection running along an imaginary circular line, which web is provided on its inside facing central axis 51 of the plastic closure, with several gas passages which are realized by rectangular recesses 43. The recesses are here distributed uniformly on the inner surface of the press-on web. Their number and distribution, however are freely choosable so long as a gas communication is ensured between the interior of the container 19 and the pressure chamber 49. Because the pressure chamber 49 stands in gas communication with the interior of the container 19 to be closed, the flange, which is part of the boundary wall of the pressure chamber 49, is pressed with sealing effect against the outer surface 23 of the container 19.

FIG. 6 again shows a highly schematic partial section through a plastic closure, a further embodiment being represented here. The basic structure of the plastic closure corresponds to the embodiment represented in FIG. 1, so that reference can be made to the description for this figure. Like parts are provided with the same reference numbers.

The plastic closure 1 is distinguished in that the sealing arrangement 11 has, besides the sealing lip 9 serving here as counter-support, a sealing disk 53, the outside diameter of which is greater than the outside diameter of the container 19. Its outer border region 55 coacts with the sealing lip 9, as will be more precisely explained below.

Upon the outer border region 55 of the sealing disk there follows an interlocking arrangement 57 which enters into engagement with the sealing lip 9 when the plastic closure 1 is screwed onto the container 19. It comprises here a bent-over border section 59, which either can be designed continuously or can have individual barbs projecting from the border of the sealing disk 53. The border section 59 is bent over to the outside, i.e., in the direction of the inner surface 13 of the side wall 5 and, in the unclosed state of the closure 1, it is arranged underneath the sealing lip 9, therefore at a greater distance from the lid 3 than the counter support 15 of the sealing lip 19. The sealing disk 53 spans the entire mouth region of the container 19. It is thinkable that in the middle of the sealing disk an aperture is provided, and therefore a sealing ring is used instead of the disk. The region of the sealing disk 53 spanning the mouth region of the container runs essentially parallel to the underside of the lid 3 and spans virtually the entire face surface 37 of the container. In the vicinity of the outer edge of the container the zone or middle zone of the sealing disk running parallel to the lid goes over into the border region 55, which extends at an angle from the inner surface of the lid 3 and finally moves over into the border section 59 here again running virtually horizontally. The sealing disk is constructed here so large that by reason of its inherent elasticity it interlocks in the interior of the plastic closure 1. The sealing disk, like the plastic closure, is made of plastic and constructed as a separate part. Instead of the sealing disk represented here there can also be used a disk that is not premolded.

Figure 6:
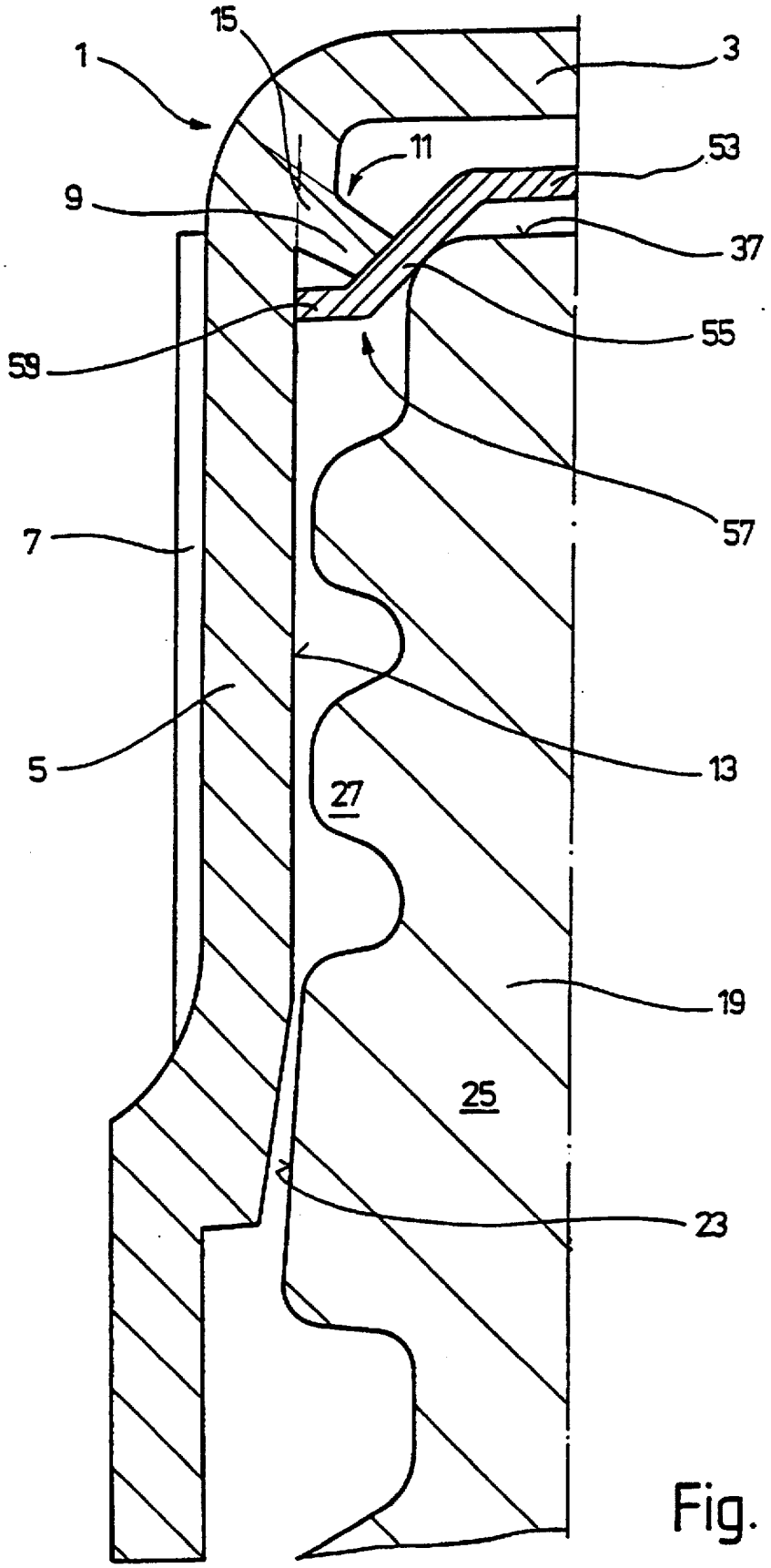
FIG. 6 a highly schematic partial section through a further embodiment of the plastic closure, which is emplaced loosely on a container.

In the representation in FIG. 6 the plastic closure 1 is emplaced on the container 19 without any application pressure.

Figure 7:
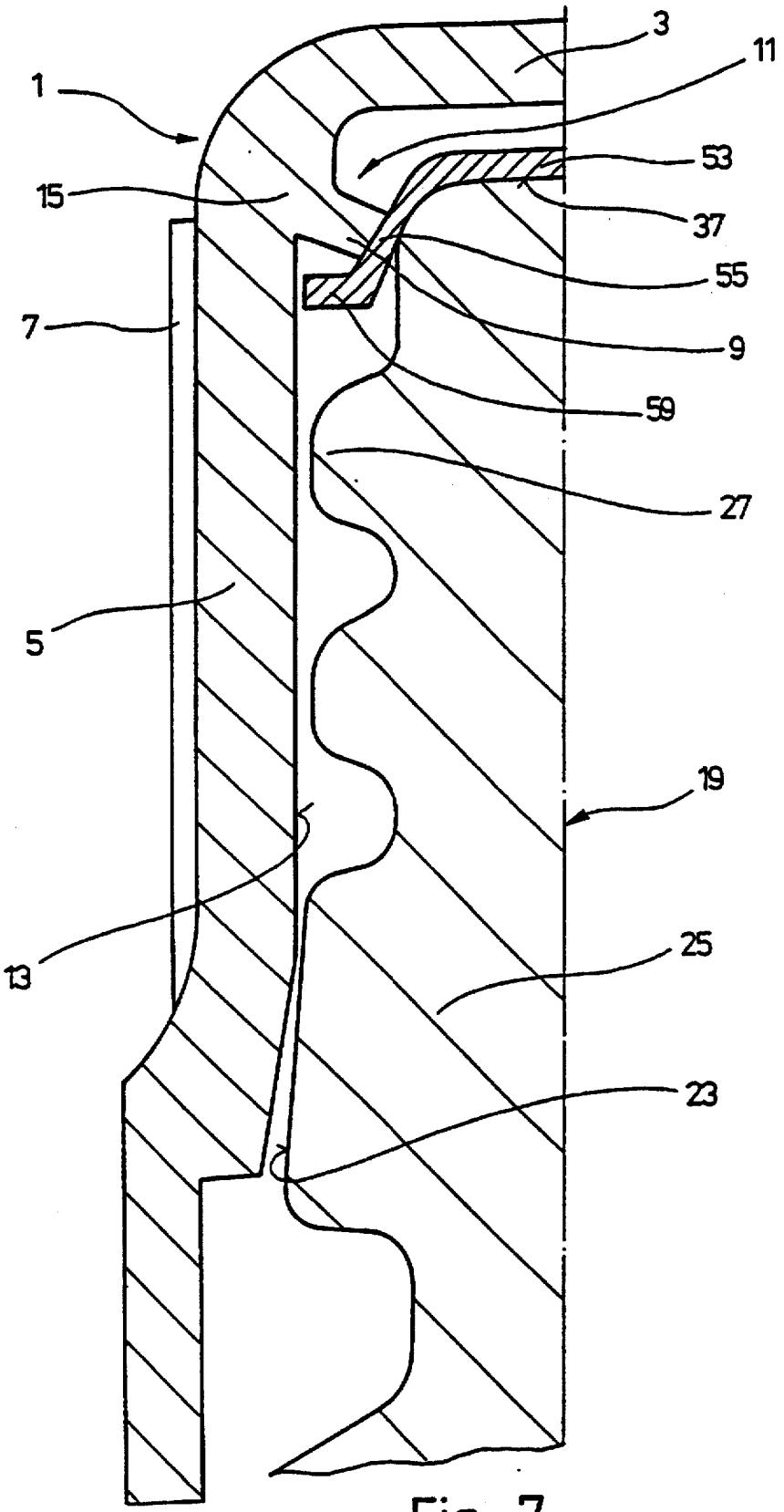
FIG. 7 a partial section through the closure according to FIG. 6 immediately after the commencement of the closing procedure and FIG. 8 a partial section through the closure according to FIGS. 6 and 7 after completion of the closing procedure.
Figure 8:
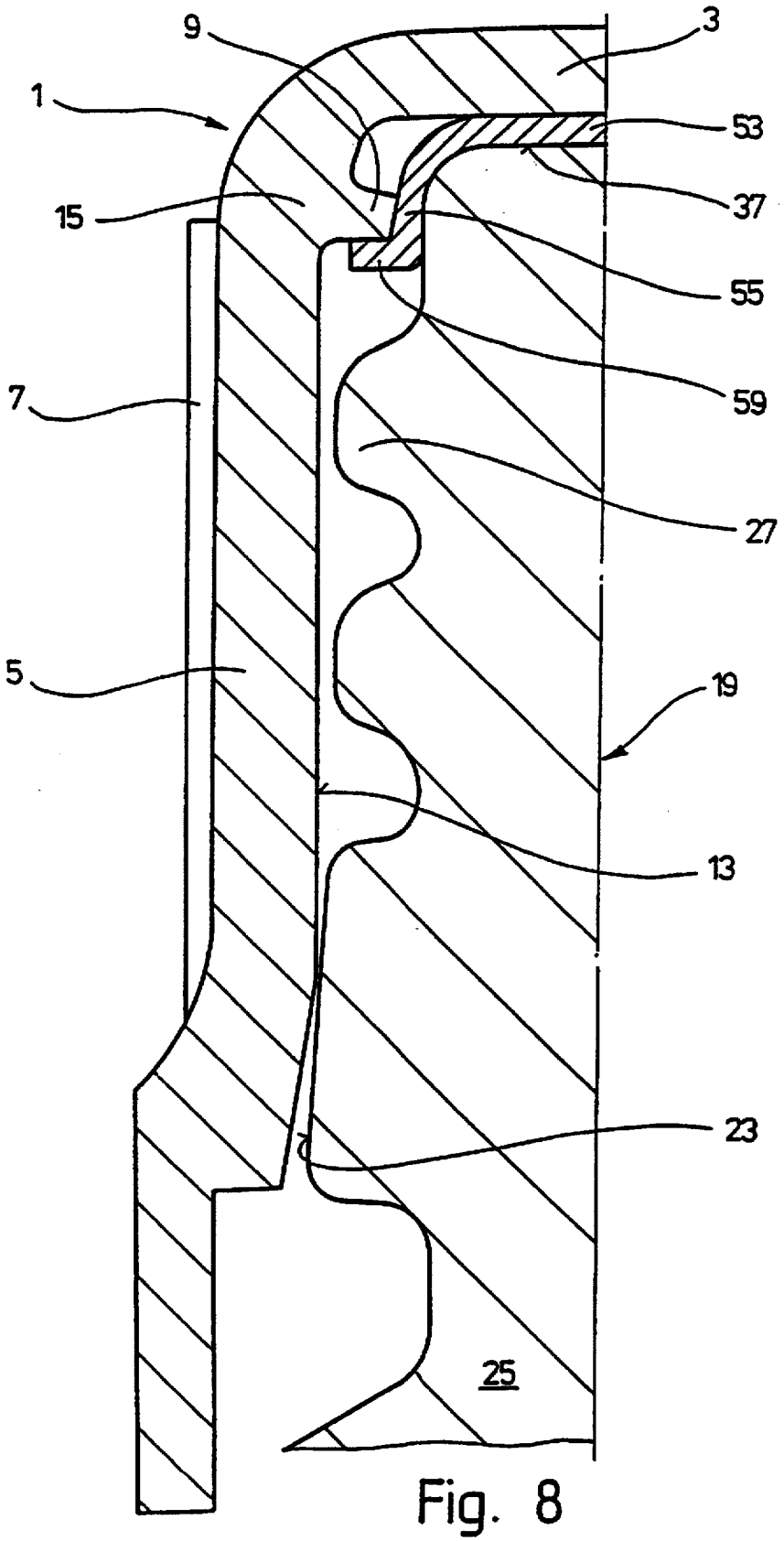

In FIGS. 7 and 8 it is shown how the sealing arrangement 11 behaves in the closing of the container 19, otherwise the representations in FIGS. 7 and 8 do not differ from that in FIG. 6. Like parts, therefore, are provided with the same reference numbers. Thus far reference is made to the representation according to FIG. 6.

In the partial section in FIG. 7 the plastic closure was brought somewhat further onto the container 19 to be closed. Here, in the interest of better perspicuity, the locking means on the inner surface 13 of the side wall 5 of the closure 1 was not represented. In the embodiment here described the closure can be provided with an inside thread and the container with an outside thread.

As closure 1 presses down onto the container 19, the sealing disk 53 is pressed by the sealing lip 9 serving as countersupport against the outer surface 23 of the side wall 25 of the container 19. The dimensions of the sealing lip 9 are chosen in such a way that its end 19 (?) lying opposite the countersupport 15 presses the sealing disk 53 firmly against the outside of the container without shearing off or pressing off the disk. The length measured between countersupport 15 and the end 17 of the sealing lip depends, therefore, on the outside diameter of the closure, on the outside diameter of the container to be closed and on the thickness of the sealing disk.

The length of the sealing lip 9 is chosen in such a way that, in common with the sealing disk 53, respectively its border region 55, it describes an inside diameter which, before the applying of the closure to a container, is somewhat smaller than its outside diameter. Thereby the container 19 is pressed during the closing process against the inner surface of the border region 55 of the sealing disk 53. During the closing process the sealing lip is displaced more and more out of the rest position running obliquely downward into its—substantially horizontal—sealing position, which is clearly evident from a comparison of FIGS. 6, 7 and 8. In FIG. 7 the sealing lip runs already somewhat flatter than the representation according to FIG. 6. Finally, as is evident from FIG. 8, the sealing lip is swung into such a position that its underside runs virtually horizontally, therewith more or less parallel to the inner surface of the lid 3. The end 17 of the sealing lip is clamped in the process between countersupport 15 and the sealing disk bearing against the outer surface 23 of the container 19, so that the sealing limit is subjected to a compression.

It is conceivable to provide the outer transition region between lid 3 and side wall 5 of the plastic closure 1 with a recess in order to ensure here a better yieldingness of the closure. By the term "recess" let there be understood here a depression or annular groove introduced from outside in the transition region between lid and side wall.

In FIG. 8 it is clear that the plastic closure 1 is completely brought onto the container 19. Since the sealing disk 23 bears on the outer contour of the container, its outside diameter is reduced so that—as a comparison of FIGS. 6, 7 and 8 shows—in the closed state of the container it no longer lies on the inner surface 13 of the side wall 5. The bent-over border section 59 now lies firmly on the underside of the sealing lip 9. The latter, therefore, is swung, on the one hand by the frictional forces between the end 17 and the sealing disk 53 into its sealing position, and on the other hand, by the active engagement of the interlocking means, respectively of the bent-over border section 59, on the sealing disk 53.

If the sealing disk 53 should be drawn inward by an internal pressure in the container 19 into the mouth region, then the cooperation of the interlocking arrangement 57, respectively of the border section 59, with the underside of the sealing lip 9, prevents the sealing disk from being completely drawn inward into the container and this later therewith becoming untight.

If the sealing disk should be provided with one or several perforations in the region spanning the mouth of the container, an internal pressure in the container can lift the lid 3 of the closure 1 so far that the sealing disk 53 no longer lies on the face surface 37 of the container. This is harmless inasmuch as a complete sealing-off of the interior of the container is achieved by the compressed sealing lip which, as stated before, is firmly clamped between its countersupport 15, respectively the side wall 5, and the sealing disk bearing on the outer surface 23 of the container 19 and is therewith subjected to a compression.

Altogether it is recognizable that the plastic closure described with the aid of FIGS. 1 to 8 is distinguished in that an optimal side sealing is ensured, which is brought about by the feature that the sealing lip 9 of the sealing arrangement 11 is borne pivotally in its countersupport 15 and is subjected to a swinging movement in the closing of the container. There the end 17 of the sealing lip theoretically follows a circular arc during the swinging movement, so that actually a reduction of the inside diameter of the sealing lip would result. Since the container 19 is constructed so rigidly that a side wall 25 does not yield, there results a compression force acting on the sealing lip. Should the sealing lip be provided with the flange 31 described with the aid of FIGS. 2 to 4, then the sealing lip is clamped between the flange lying on the outer surface 23 and the countersupport 15 and is subjected there to compression. In any case there is yielded a very good side sealing which also surely closes off high internal pressures of the container.

The sealing effect generated by the sealing lip is yielded as it were by a crank effect arising during the pivoting of the sealing lip.

From the manner of functioning of the sealing lip it is evident that this latter can also engage on the inside of the side wall. There is required merely the mounting of an annular beading which projects from the inside of the lid 3 into the mouth of the container 19 to be closed. This latter can then serve as support of a sealing lip—projecting from the annular beading in the direction of the side wall of the closure—which in its rest position runs obliquely downward and which has an outside diameter that is somewhat greater than the inside diameter of the container. If such a closure is emplaced on the container, the sealing lip, as in the embodiments described here of the closure, is swung out of the rest position into a virtually horizontal sealing position and in the process is subjected to a compression. The basic principle of the sealing lip, therefore, remains preserved.

It is also conceivable, finally, to provide the closure with two sealing lips, one of which engages on the outside and the other on the inside of the container wall surrounding the mouth.

The sealing effect of the sealing lip depends, in the first place, on the dimensional tolerances, therefore on the inside diameter circumscribed by the sealing lip (see the embodiment according to FIGS. 1 to 8), respectively on an outside diameter formed by the sealing lip if this proceeds from an annular beading arising from the inside of the lid. In the second place, the thickness of the sealing lip is decisive. Finally, an essential condition is the material of the sealing lip which is here pressed against the container wall while the compression of the sealing lip occurs.

We claim:

1. Plastic closure for closing a mouth region of a container, said closure including a lid allocated to the container mouth, an annular side wall connected with and proceeding from the lid, and sealing means for closing the container, characterized in that the sealing means has a circumferential pivotable sealing lip projecting from a support of said closure, said lip coacting with a side wall surrounding the container mouth of the container, so that in the closing of the container the lip is swung out of a rest position into a sealing position in which sealing position said lip is clamped between said support and the side wall of the container so that said sealing lip of said sealing means is subjected to compression in a direction outwardly toward said support, from an inner portion of said sealing lip which engages said side wall of the container, characterized by a stop coating with the face of the container, wherein the stop has individual projections distributed along an imaginary circular line, the interspaces of which serve as gas passages.

2. Plastic closure for closing a mouth region of a container, said closure including a lid allocated to the container mouth, an annular side wall connected with and proceeding from the lid, and sealing means for closing the container, characterized in that the sealing means has a circumferential pivotable sealing lip projecting from a support of said closure, said lip coacting with a side wall surrounding the container mouth of the container, so that in the closing of the container the lip is swung out of a rest position into a sealing position in which said lip is clamped between said support and the side wall of the container so that said sealing lip of said sealing means is subjected to compression in a direction outwardly toward said supports, from an inner portion of said sealing lip which engages said side wall of the container, characterized by a stop coacting with the face of the container, wherein the stop is constructed as a continuous annular projection which presents at least one gas passage.

* * * * *